US010703098B2

(12) United States Patent
Okazawa

(10) Patent No.: US 10,703,098 B2
(45) Date of Patent: Jul. 7, 2020

(54) LIQUID EJECTING APPARATUS AND METHOD

(71) Applicant: SEIKO EPSON CORPORATION, Tokyo (JP)

(72) Inventor: Noriaki Okazawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/360,658

(22) Filed: Mar. 21, 2019

(65) Prior Publication Data

US 2019/0291424 A1 Sep. 26, 2019

(30) Foreign Application Priority Data

Mar. 22, 2018 (JP) ..... 2018-054068
Oct. 18, 2018 (JP) ..... 2018-196578

(51) Int. Cl.
*B41J 2/045* (2006.01)
*B41J 2/175* (2006.01)
*B41J 2/18* (2006.01)
*B41J 2/14* (2006.01)

(52) U.S. Cl.
CPC ..... *B41J 2/04588* (2013.01); *B41J 2/04551* (2013.01); *B41J 2/04581* (2013.01); *B41J 2/14233* (2013.01); *B41J 2/175* (2013.01); *B41J 2/18* (2013.01); *B41J 2002/14419* (2013.01); *B41J 2202/07* (2013.01); *B41J 2202/12* (2013.01)

(58) Field of Classification Search
CPC ..... B41J 2/04588; B41J 2/04581; B41J 2/18; B41J 2/175
USPC ..... 347/9, 10, 68, 70–72
See application file for complete search history.

(56) References Cited

U.S. PATENT DOCUMENTS 7,374,263 B2 * 5/2008 Hosono ..... B41J 2/04516 347/10
7,559,632 B2 * 7/2009 Kodama ..... B41J 2/04543 347/68
9,682,547 B2 * 6/2017 Yamagishi ..... B41J 2/16508
10,300,706 B2 * 5/2019 Miyazawa ..... C09D 11/322
2008/0316278 A1 12/2008 Van Den Bergen
(Continued)

FOREIGN PATENT DOCUMENTS

EP 1741556 1/2007
JP 2002-234175 A 8/2002
(Continued)

*Primary Examiner* — An H Do
(74) *Attorney, Agent, or Firm* — Workman Nydegger

(57) ABSTRACT

A liquid ejecting apparatus includes a nozzle for ejecting liquid, a pressure chamber communicating with the nozzle, a first individual flow path communicating with the pressure chamber, a second individual flow path communicating with the pressure chamber, a pressure generating unit changing a pressure of the liquid in the pressure chamber, and a control unit for driving the pressure generating unit. In the liquid ejecting apparatus, the liquid is supplied into the pressure chamber via one of the first individual flow path and the second individual flow path, and at least a part of the liquid supplied into the pressure chamber is discharged via the other. The control unit introduces air into the pressure chamber via the nozzle by driving the pressure generating unit, during a period in which the liquid is not ejected from the nozzle.

16 Claims, 10 Drawing Sheets

(56) References Cited

U.S. PATENT DOCUMENTS

| | | | |
|---|---|---|---|
| 2009/0128603 | A1 | 5/2009 | Drury |
| 2010/0214334 | A1 | 8/2010 | Kusunoki et al. |
| 2012/0062627 | A1 | 3/2012 | Nitta et al. |
| 2016/0046123 | A1 | 2/2016 | Yamagishi |

FOREIGN PATENT DOCUMENTS

| | | | |
|---|---|---|---|
| JP | 5178577 | B | 9/2010 |
| JP | 5784660 | B | 6/2013 |
| JP | 2013-212660 | A | 10/2013 |
| JP | 2014-184682 | A | 1/2014 |

* cited by examiner

LIQUID EJECTING APPARATUS AND METHOD

BACKGROUND

1. Technical Field

The present invention relates to a liquid ejecting apparatus.

2. Related Art

In a liquid ejecting apparatus, for example in JP-A-2002-234175, it is conceivable to provide a liquid ejecting apparatus including a liquid ejecting head having a nozzle for ejecting ink and an ink circulation system for circulating the ink to the liquid ejecting head. In the liquid ejecting apparatus, a pressure change is transmitted to the ink in the vicinity of a nozzle outlet by raising or lowering a pressure of the ink flowing through the ink circulation system, and a meniscus surface of the ink formed in the vicinity of the nozzle outlet is reciprocated to suppress an increase in viscosity of the ink.

In the liquid ejecting apparatus described above, the pressure of the ink flowing through the ink circulation system is raised or lowered in order to suppress an increase in viscosity of the ink in the vicinity of the nozzle outlet. Therefore, it is impossible to complete an operation for suppressing the increase in viscosity of the ink in the vicinity of the nozzle outlet in a short time.

SUMMARY

According to an aspect of the invention, there is provided a liquid ejecting apparatus. The liquid ejecting apparatus includes a nozzle for ejecting liquid, a pressure chamber communicating with the nozzle, a first individual flow path communicating with the pressure chamber, a second individual flow path communicating with the pressure chamber, a pressure generating unit changing a pressure of the liquid in the pressure chamber, and a control unit for driving the pressure generating unit. The liquid is supplied into the pressure chamber through one of the first individual flow path and the second individual flow path, and at least a part of the liquid supplied into the pressure chamber is discharged through the other. The control unit introduces air into the pressure chamber through the nozzle by driving the pressure generating unit during a period in which the liquid is not ejected from the nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
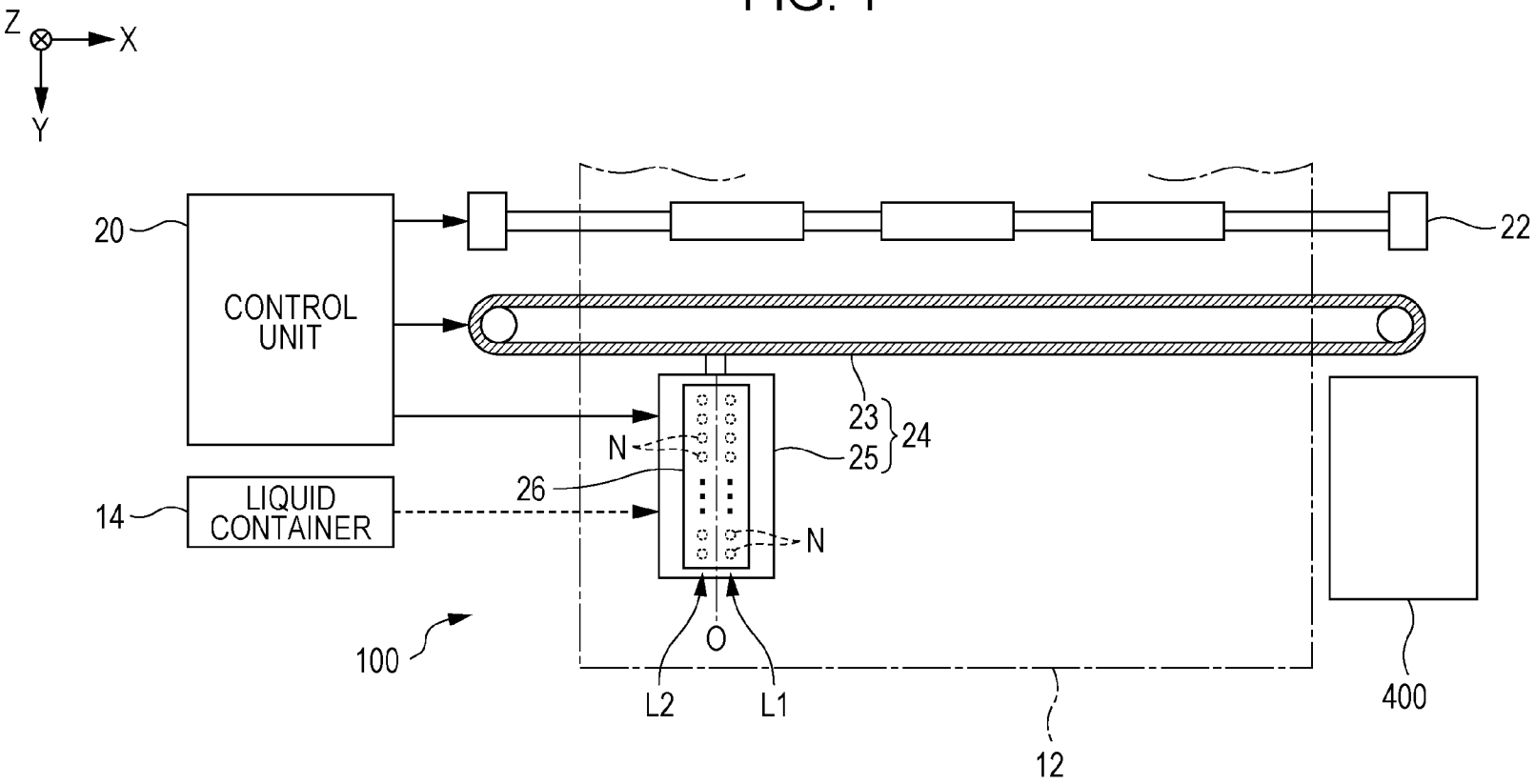
FIG. 1 is an explanatory view schematically showing a configuration of a liquid ejecting apparatus.

FIG. 1 is an explanatory view schematically showing a configuration of a liquid ejecting apparatus 100 according to an embodiment of the present disclosure.

The liquid ejecting apparatus 100 is an ink jet type printing apparatus that ejects ink, which is an example of liquid, onto a medium 12. The liquid ejecting apparatus 100 uses a printing target of any material such as a resin film or cloth as well as printing paper as the medium 12 and performs printing on these various media 12. An X direction shown in each drawing in FIG. 1 and thereafter is a moving direction (main scanning direction) of a liquid ejecting head 26 described later, a Y direction is a medium feeding direction (sub scanning direction) orthogonal to the main scanning direction, and a Z direction is a direction orthogonal to an XY plane and is a direction along an ink ejecting direction. In the following description, the main scanning direction may be referred to as the X direction and the sub scanning direction may be to as the Y direction for convenience of explanation. In addition, when specifying an orientation, positive and negative correspondences are used in conjunction with direction notations.

The liquid ejecting apparatus 100 includes a liquid container 14, a transport mechanism 22 that transports the medium 12, a control unit 20, a head moving mechanism 24, a liquid ejecting head 26, and a head cap 400. The liquid container 14 stores the ink ejected from the liquid ejecting head 26. As the liquid container 14, a bag-shaped ink pack formed of a flexible film, an ink tank capable of replenishing the ink, or the like can be used. The control unit 20 includes a processing circuit such as a central processing unit (CPU) and a field programmable gate array (FPGA) and a memory circuit such as a semiconductor memory and controls the transport mechanism 22, the head moving mechanism 24, the liquid ejecting head 26, or the like. The transport mechanism 22 operates under the control of the control unit 20 and sends the medium 12 in the +Y direction.

The head moving mechanism 24 includes a head moving belt 23 bridging over a printing range of the medium 12 in the X direction, and a carriage 25 that houses the liquid ejecting head 26 and fixes the liquid ejecting head 26 to the head moving belt 23. The head moving mechanism 24 operates under the control of the control unit 20 and causes the liquid ejecting head 26 to reciprocate together with the carriage 25 in the main scanning direction (X direction). When the carriage 25 reciprocates, the carriage 25 is guided by a guide rail, but an illustration of the guide rail is omitted. Further, a head configuration in which a plurality of liquid ejecting heads 26 are mounted on the carriage 25 or a head configuration in which the liquid container 14 is mounted on the carriage 25 together with the liquid ejecting head 26 may be used.

The head cap 400 is disposed outside of the printing range in the +X direction. The head cap 400 is driven under the control of the control unit 20. The head cap 400 is used for a suction operation or a flushing operation for discharging the ink from a nozzle N of the liquid ejecting head 26 into the head cap 400 when the carriage 25 moves to be above the head cap 400. A pump (not shown) and a waste liquid tank are connected to the head cap 400. In the case of the suction operation, the head cap 400 is driven in the Z direction to cover the liquid ejecting head 26, and the ink discharged into the head cap 400 by driving the pump flows from the head cap 400 to the waste liquid tank. When the liquid ejecting head 26 is not configured to be movable via the carriage 25, for example, like a line printer, the liquid ejecting apparatus 100 is provided such that the head cap 400 may be configured to be movable to a lower side of the liquid ejecting head 26 to cover the liquid ejecting head 26.

The liquid ejecting head 26 ejects the ink supplied from the liquid container 14 under the control of the control unit 20 from the plurality of nozzles N toward the medium 12. A desired image or the like is printed on the medium 12 by ejecting the ink from the nozzle N during reciprocation of the liquid ejecting head 26. As shown in FIG. 1, the liquid ejecting head 26 includes a nozzle row in which the plurality of nozzles N are arranged in the sub scanning direction, and has two rows of the nozzles separated at a predetermined interval along the main scanning direction. These two nozzle rows are shown as a first nozzle row L1 and a second nozzle row L2 in FIG. 1 to FIG. 4, and the nozzle N of the first nozzle row L1 and the nozzle N of the second nozzle row L2 are arranged in the main scanning direction. In the following description, a YZ plane that is parallel to a Y axis and a Z axis and is equidistant from the first nozzle row L1 and the second nozzle row L2, is defined as a center plane O for convenience of explanation.

The line of the nozzles N in the first nozzle row L1 and the second nozzle row L2 may be arranged in a zigzag pattern shifted with respect to the medium feeding direction (Y direction). The liquid ejecting apparatus 100 may have a configuration having only the first nozzle row L1 without having the second nozzle row L2. The liquid ejecting apparatus 100 may have a configuration having three or more nozzle rows.

Figure 2:
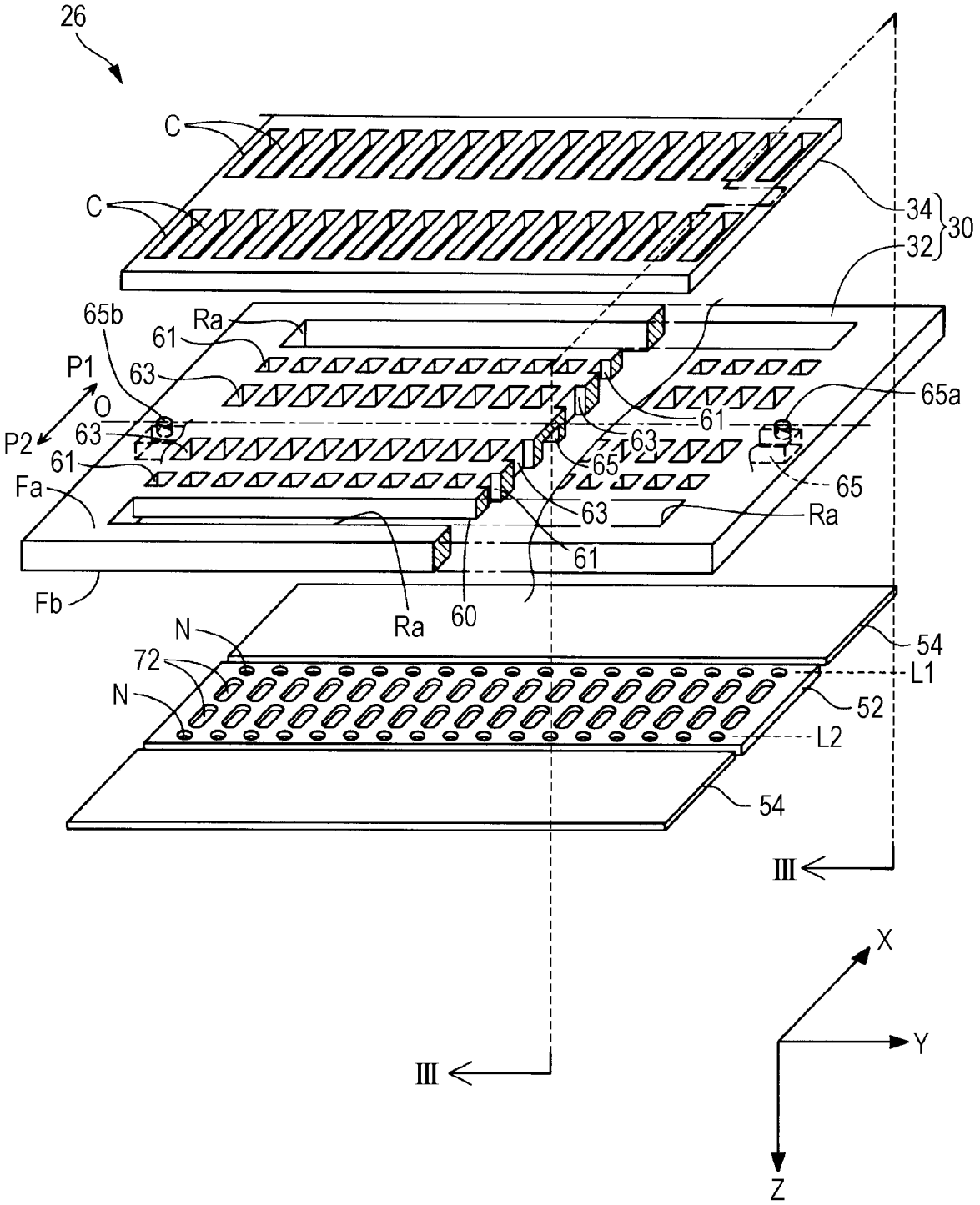
FIG. 2 is an explanatory view showing the liquid ejecting head in an exploded manner.
Figure 3:
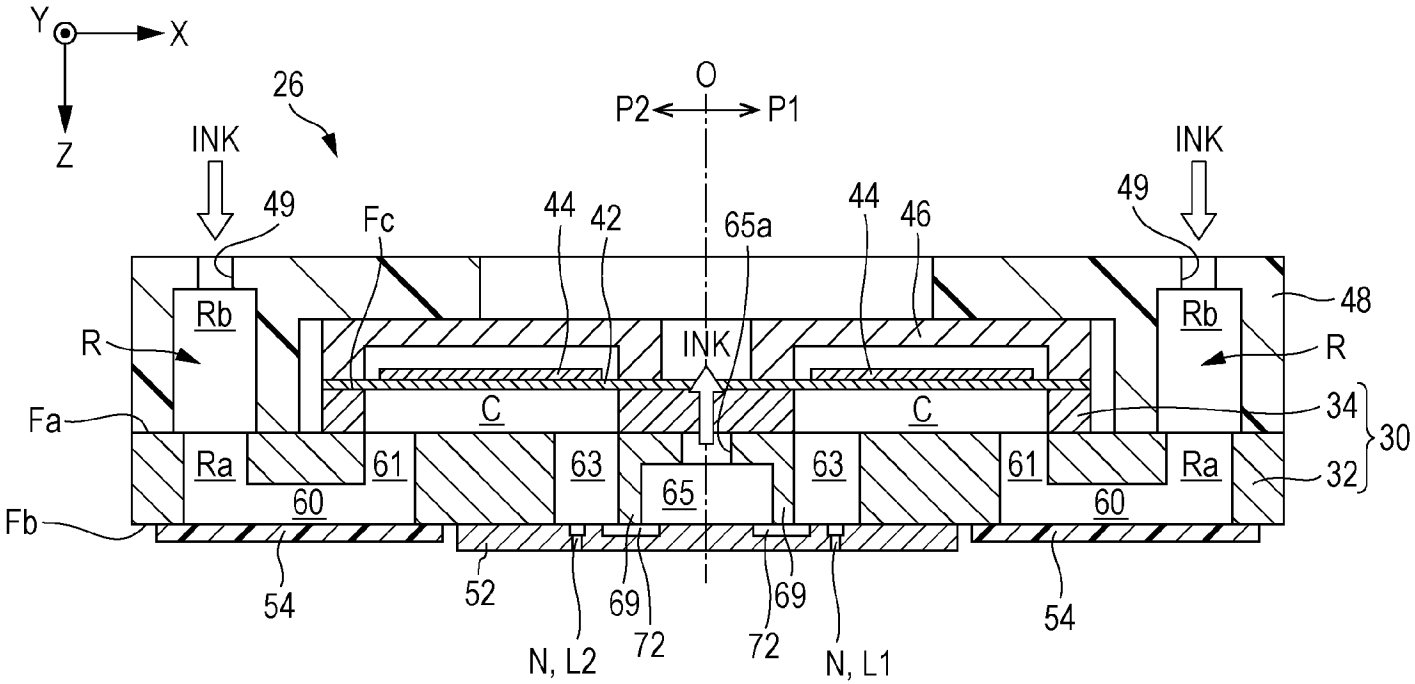
FIG. 3 is a schematic cross-sectional view taken along line III-III of the liquid ejecting head.

FIG. 2 is an explanatory view showing main head components of the liquid ejecting head 26 in an exploded manner. FIG. 3 is an explanatory view showing the liquid ejecting head 26 in cross-sectional view taken along line III-III in FIG. 2. As shown in the figures, the liquid ejecting head 26 having the first nozzle row L1 and the second nozzle row L2 is a laminated body in which the head components are laminated. It should be noted that thicknesses of the respective constituent members shown do not show actual component thicknesses. In addition, in FIG. 2, a part of a first flow path substrate 32 which is a component is omitted for convenience of illustration.

As shown in FIG. 3, the liquid ejecting head 26 is provided such that a configuration relating to the nozzle N of the first nozzle row L1 and a configuration related to the nozzle N of the second nozzle row L2 are in plane symmetry with respect to the center plane O. In other words, a common configuration is provided in the first part P1 on the +X direction side and the second part P2 on the −X direction side with respect to the center plane O interposed therebetween in the middle of the liquid ejecting head 26. The nozzle N of the first nozzle row L1 belongs to the first part P1, the nozzle N of the second nozzle row L2 belongs to the second part P2, and the center plane O is a boundary plane between the first part P1 and the second part P2.

The liquid ejecting head 26 includes, as a main constituent member, a flow path forming unit 30 related to flow path formation in the liquid ejecting head 26 and a housing portion 48 related to ink supply and discharge. The flow path forming unit 30 is configured by laminating the first flow path substrate 32 and a second flow path substrate 34. Both substrates of the first flow path substrate 32 and the second flow path substrate 34 are plate bodies elongated in the Y direction, and the second flow path substrate 34 is fixed on an upper surface Fa of the first flow path substrate 32 in the −Z direction using an adhesive.

A vibrator 42, a plurality of piezoelectric elements 44, a protection member 46, and a housing portion 48 are installed on the side of the upper surface Fc of the second flow path substrate 34. The vibrator 42 is a thin-shaped plate body which is elongated in the Y direction and installed over the first part P1 and the second part P2. The protection member 46 is a plate body which is elongated in the Y direction and installed over the first part P1 and the second part P2. The protection member 46 forms a recessed space on the upper surface side of the vibrator 42 to cover the vibrator 42. The housing portion 48 is a plate body elongated in the Y direction. The protection members 46 disposed on both sides of the center plane O may be interposed between the housing portion 48 and the second flow path substrate 34. In addition, a nozzle plate 52 and a vibration absorber 54 are disposed on a lower surface Fb of the first flow path substrate 32 in the Z direction. Both the nozzle plate 52 and the vibration absorber 54 are plate bodies elongated in the Y direction. The nozzle plate 52 is installed across the center plane O from the first part P1 to the second part P2. The vibration absorber 54 is individually installed in the first part P1 and the second part P2. Each of these elements is bonded respectively to the upper surface Fa or the lower surface Fb of the first flow path substrate 32 by using an adhesive.

As shown in FIG. 2, the nozzle plate 52 includes the nozzle N of the first part P1 and the nozzle N of the second part P2 in a row shape, and two rows of second individual flow paths 72 between the first nozzle row L1 in which the nozzles N of the first part P1 are arranged and the second nozzle row L2 in which the nozzles N of the second part P2 are arranged.

A first individual flow path 61 will be described later. Each of the nozzles N is a circular through hole through which the ink is ejected. As shown in FIG. 3, the second individual flow path 72 is a recessed groove formed on the surface of the nozzle plate 52. Of course, the second individual flow path 72 may be provided as a recessed groove formed on the surface of the first flow path substrate 32, not as the recessed groove formed on the surface of the nozzle plate 52. The second individual flow path 72 of the row on the +X direction side is formed next to the nozzle N in the first nozzle row L1, and the second individual flow path 72 of the row on the −X direction side is formed next to the nozzle N in the second nozzle row L2. The nozzle plate 52 is formed so as to have the nozzle N and the second individual flow path 72 through the application of a semiconductor manufacturing technique to a single crystal substrate of silicon (Si), for example, a processing technique such as dry etching or wet etching.

As shown in FIG. 3, the vibration absorber 54 forms the bottom surface of the liquid ejecting head 26 together with the nozzle plate 52. The vibration absorber 54 is adhered to the lower surface Fb of the first flow path substrate 32, thereby forming the bottom surface of an ink inflow chamber Ra, a first common flow path 60 and the first individual flow path 61. The vibration absorber 54 is configured with, for example, a flexible film that absorbs a pressure fluctuation in the ink inflow chamber Ra, and a substrate that supports the film.

The nozzle plate 52 and the vibration absorber 54 are adhered to the first flow path substrate 32, thereby forming the ink inflow chamber Ra, the first common flow path 60, the first individual flow path 61, and a communication path 63, respectively in the first part P1 and the second part P2. Further, a second common flow path 65 which is common to the first part P1 and the second part P2 is formed. As shown in FIG. 2, the ink inflow chamber Ra is formed as an elongated through opening along the Y direction in the first flow path substrate 32. The first individual flow path 61 and the communication path 63 are formed as through holes in the first flow path substrate 32. The first common flow path 60 is formed as an elongated recessed groove extending in the X direction from the ink inflow chamber Ra on the lower surface Fb of the first flow path substrate 32. As shown in FIG. 3, the vibration absorber 54 is adhered to the lower surface Fb of the first flow path substrate 32, thereby forming the ink inflow chamber Ra, the first common flow path 60, and the first individual flow path 61. The ink inflow chamber Ra, the first common flow path 60, and the first individual flow path 61 are involved in supplying the ink to the respective nozzles N.

As shown in FIG. 2, the second common flow path 65 is formed as an elongated recessed groove extending in the Y direction on the lower surface Fb of the first flow path substrate 32. As shown in FIG. 3, the nozzle plate 52 is adhered to the lower surface Fb of the first flow path substrate 32, thereby forming the communication path 63 and the second common flow path 65. The nozzle plate 52 includes the respective nozzles N of the first nozzle row L1 and the second nozzle row L2, and a second individual flow path 72. The respective nozzles N are disposed at a position overlapping with the communication path 63 in plan view from the Z direction. The second individual flow path 72 is disposed at a position overlapping with the partition wall portion 69 that divides the communication path 63 and the second common flow path 65 for each nozzle row in plan view from the Z direction. The second individual flow path 72 is an ink flow path that straddles the partition wall portion 69 and is provided by the nozzle plate 52 being adhered to the lower surface Fb of the first flow path substrate 32. For each nozzle N, the second individual flow path 72 allows the communication path 63 to communicate with the second common flow path 65. The second common flow path 65 is responsible for discharging the ink from the communication path 63 by receiving the ink from the communication path 63 for each nozzle N via the respective second individual flow paths 72.

Further, as shown in FIG. 2, the second common flow path 65 is a recessed groove longer than the arrangement of the nozzles N in the first nozzle row L1 and the second nozzle row L2 and has circulation ports 65*a*, 65*b* at both ends of the groove. The circulation ports 65*a* and 65*b* are through holes penetrating the bottom wall of the second common flow path 65 of the recessed groove, that is, the first flow path substrate 32, and are connected to circulation piping in a circulation mechanism 75 to be described later. The circulation ports 65*a* and 65*b* may be connected to the circulation piping in the circulation mechanism 75 via a flow path provided in the housing portion 48 at a position different from the cross section of line III-III. After flowing into the communication path 63, the ink passes through the second individual flow path 72, enters the second common flow path 65, and is discharged from the liquid ejecting head 26 via the circulation ports 65*a* and 65*b* of the second common flow path 65. The discharged ink is circulated to the ink inlet 49 by the circulation mechanism 75 to be described later.

The second flow path substrate 34 bonded to the upper surface Fa of the first flow path substrate 32 forms a pressure chamber C in each of the first part P1 and the second part P2. This pressure chamber C is a through hole formed for each of the nozzles N of the first nozzle row L1 and the second nozzle row L2 in the X direction. On the lower end side of the through hole in the +Z direction, the pressure chamber C communicates with the first individual flow path 61 and the communication path 63 of the first flow path substrate 32. In this specification, when the pressure chamber C and the communication path 63 are described without being distinguished from each other, the pressure chamber C and the communication path 63 may be collectively referred to as the pressure chamber C. In the pressure chamber C, the upper end side of the through hole in the −Z direction is closed by the vibrator 42 interposed between the second flow path substrate 34 and the protection member 46. Of course, the pressure chamber C may not be formed by the through hole provided in the second flow path substrate 34 and the vibrator 42, but may be formed by an integral formation of the second flow path substrate 34 and the vibrator 42. The pressure chamber C whose upper end side is closed in this manner functions as a cavity for each nozzle N of the first nozzle row L1 and the second nozzle row L2. The first flow path substrate 32 and the second flow path substrate 34 described above are formed through application of the above-described semiconductor manufacturing technique to a silicon single crystal substrate, similarly to the nozzle plate 52.

The vibrator 42 interposed between the second flow path substrate 34 and the protection member 46 is a plate-shaped member which is capable of vibrating elastically. A piezoelectric element 44 is provided for each pressure chamber C on the upper side of the vibrator 42. Accordingly, one piezoelectric element 44 is provided for one nozzle N. The piezoelectric element 44 is a passive element that deforms upon receipt of a drive signal from the control unit 20. Due to the vibration of the piezoelectric element 44, a pressure change occurs in the supplied ink in the pressure chamber C. The pressure change reaches the nozzle N via the communication path 63.

The protection member 46 is a plate-shaped member for protecting each piezoelectric element 44 and is stacked on the first flow path substrate 32 in a state where the vibrator 42 is interposed between the protection member 46 and the second flow path substrate 34. The protection member 46 may be formed through the application of the above-described semiconductor manufacturing technique to a silicon single crystal substrate, similar to the first flow path substrate 32 and the second flow path substrate 34, or even may be formed of other materials. The housing portion 48 is a member that covers the upper surface side of the liquid ejecting head 26, and is responsible for the protection of the entire head, the storage of the ink supplied to the pressure chamber C for each nozzle N, and the ink supply from the liquid container 14 (see FIG. 1). More specifically, the housing portion 48 includes an upstream ink inflow chamber Rb that overlaps with the ink inflow chamber Ra of the first flow path substrate 32 in the Z direction, and the upstream ink inflow chamber Rb and the ink inflow chamber Ra of the first flow path substrate 32 forms an ink storage chamber (reservoir R). The supply of the ink to the upstream ink inflow chamber Rb is performed from the ink inlet 49 on the ceiling wall of the inflow chamber. The housing portion 48 is formed by injection molding of an appropriate resin material.

Figure 4:
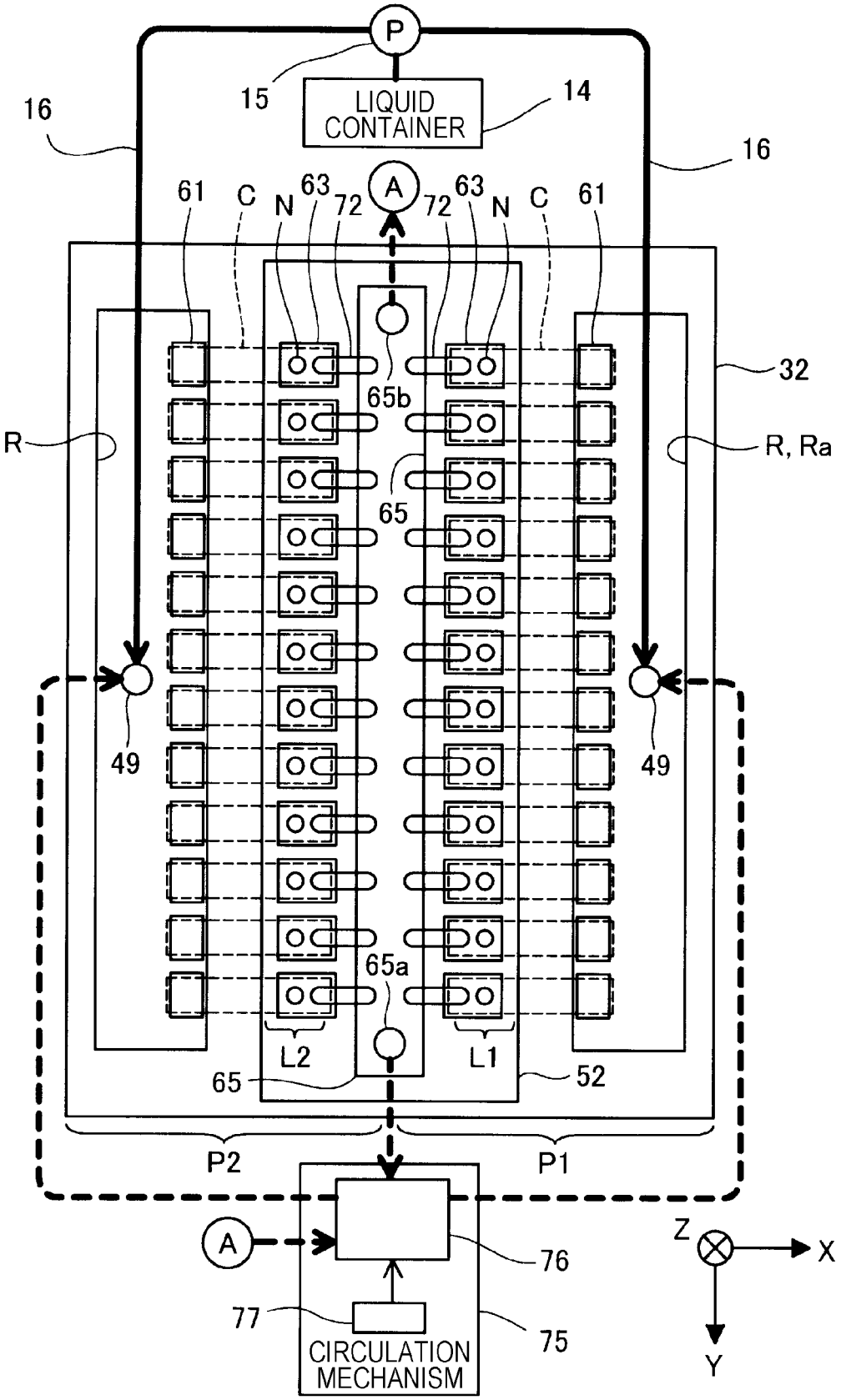
FIG. 4 is an explanatory view showing a flow path of liquid in the liquid ejecting head.

FIG. 4 is an explanatory view showing the ink supply path and the ink circulation path to the nozzle N by superimposing various flow path forming units such as the first individual flow path 61 in the liquid ejecting head 26. Further, in FIG. 4, various path forming units are shown overlapping when viewed from the Z axis direction.

As shown in the figure, the reservoir R configured with the ink inflow chamber Ra and the first common flow path 60 (see FIG. 3) in the first flow path substrate 32 extends in the Y direction along each of the first nozzle row L1 and the second nozzle row L2. In the first part P1, the reservoir R overlaps with the first individual flow path 61 for each nozzle, corresponding to each nozzle N in the first nozzle row L1. Further, in the second part P2, the reservoir R overlaps with the first individual flow path 61 corresponding to each nozzle N in the second nozzle row L2. The first individual flow path 61 for each nozzle row overlaps with the pressure chamber C of each nozzle N, and the pressure chamber C overlaps with the communication path 63 of each nozzle row. The communication path 63 of the first flow path substrate 32 overlaps with the nozzle N of the nozzle plate 52 shown in FIG. 3. Accordingly, the ink stored in the reservoir R after receiving a force feed pressure of the pump 15 from the liquid container 14 flows through a supply pipe 16, is supplied to the communication path 63 via the first individual flow path 61 and the pressure chamber C, receives vibration of the piezoelectric element 44 via the pressure chamber C, and is ejected from the nozzle N. The supply of the ink from the liquid container 14 is continued also in a liquid ejecting mode and an air introduction mode described later (see FIGS. 6 to 7).

As the ink is ejected from the nozzle N, the ink is supplied from the liquid container 14 and the circulation mechanism 75, to the reservoir R via the ink inlet 49. The circulation mechanism 75 includes an ink storage tank 76 and a pressure adjustment portion 77 that adjusts the pressure in the storage tank to a pressure lower than the force feed pressure of the pump 15. The circulation mechanism 75 receives a circulating ink described later from the second common flow path 65 via the circulation port 65*a* and the circulation port 65*b* and circulates the received circulating ink to the reservoir R via the ink inlet 49. The circulation of the circulating ink to the reservoir R via the ink inlet 49 is performed by the pressure adjustment of the pressure adjustment portion 77.

The second common flow path 65 is provided so as to extend in the Y direction between the first nozzle row L1 and the second nozzle row L2. The second common flow path 65 has the circulation port 65*a* at the end portion in the +Y direction, and the circulation port 65*b* at the end portion in the −Y direction. The second common flow path 65 overlaps with the second individual flow path 72 corresponding to each nozzle N in the first nozzle row L1 in the first part P1 and overlaps with the second individual flow path 72 corresponding to each nozzle N in the second nozzle row L2 in the second part P2. Therefore, in a state where ink supply to the pressure chamber C is continued, the ink exceeding the sum of the internal volume of the pressure chamber C and the communication path 63 flows through the communication path 63 and the second individual flow path 72 to be pushed out to the second common flow path 65, reaches the circulation mechanism 75 as the circulating ink via the circulation ports 65*a* and 65*b*, and is circulated to the reservoir R by the circulation mechanism 75.

Figure 5:
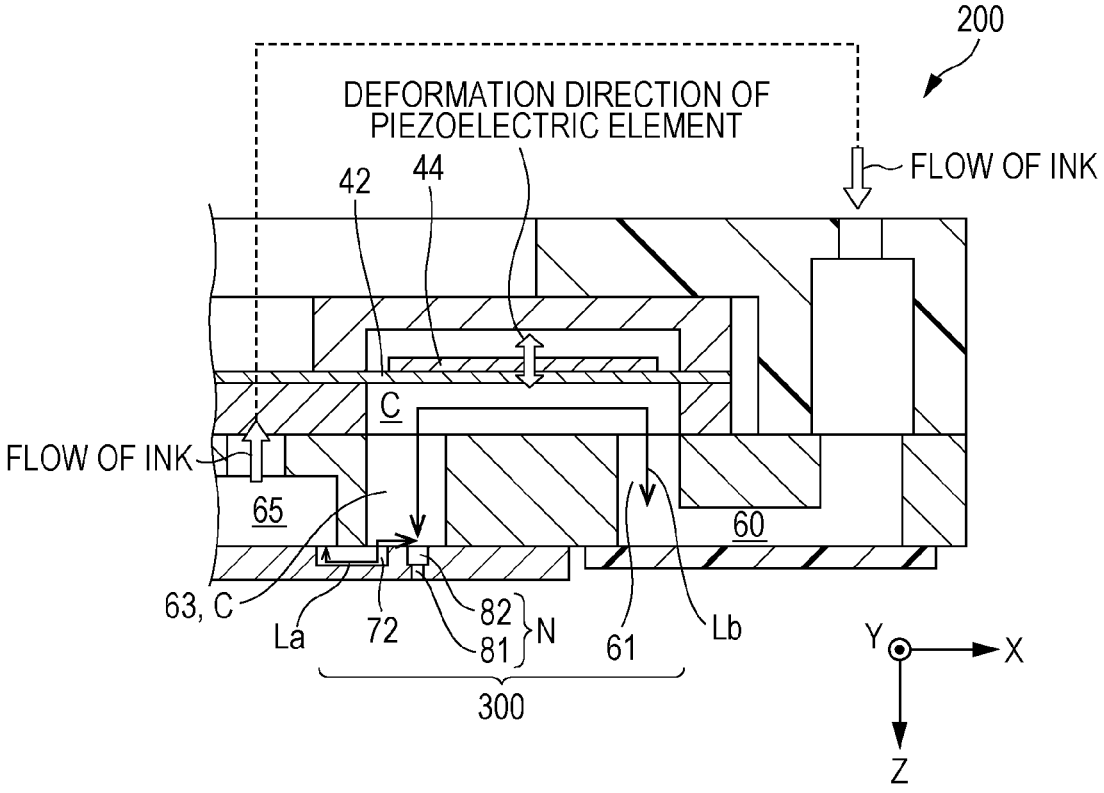
FIG. 5 is an explanatory view schematically showing a flow path communicating with one nozzle.

FIG. 5 is an explanatory view schematically showing a flow path communicating with one nozzle N. FIG. 5 shows the first part P1 in FIG. 3. In this specification, a flow path provided for the ink circulation in the liquid ejecting apparatus 100 is also referred to as a circulation flow path 200. Further, the preceding flow path where the ink flow is branched into each pressure chamber C is referred to as an individual flow path 300.

The circulation flow path 200 includes the first common flow path 60, the plurality of individual flow paths 300, and the second common flow path 65. The upstream side of the first common flow path 60 communicates with the liquid container 14 and the ink storage tank 76, and the ink flows into the first common flow path 60 from the liquid container 14 and the ink storage tank 76. The downstream side of the first common flow path 60 communicates with the plurality of individual flow paths 300, and the ink flows from the first common flow path 60 into each of the individual flow paths 300. The upstream side of the second common flow path 65 communicates with the plurality of individual flow paths 300, and the ink flows from each of the individual flow paths 300 into the second common flow path 65. The downstream side of the second common flow path 65 communicates with the ink storage tank 76, and the ink in the second common flow path 65 flows into the ink storage tank 76. Although the liquid ejecting apparatus 100 of the present embodiment has the plurality of individual flow paths 300, the number of individual flow paths may be only one.

Each of the individual flow paths 300 includes the first individual flow path 61, the pressure chamber C, and the second individual flow path 72. The upstream side of the first individual flow path 61 communicates with the first common flow path 60, and the downstream side of the first individual flow path 61 communicates with the pressure chamber C. The pressure chamber C communicates with the nozzle N for ejecting the ink. The upstream side of the second individual flow path 72 communicates with the pressure chamber C, and the downstream side of the second individual flow path 72 communicates with the second common flow path 65. Therefore, the ink is supplied into the pressure chamber C via the first individual flow path 61, and the ink remaining in the pressure chamber C without being consumed by ejection from the nozzle N flows through the second individual flow path 72 and is discharged from the inside of the pressure chamber C.

Each of the pressure chambers C includes the nozzle N described above, the vibrator 42, and the piezoelectric element 44. The nozzle N of the present embodiment is provided on the bottom surface (nozzle plate 52) of the pressure chamber C. The nozzle N of the present embodiment has a first diameter portion 81 having a small inner diameter and a second diameter portion 82 connected to the first diameter portion 81 and having an inner diameter larger than the inner diameter of the first diameter portion 81. The first diameter portion 81 communicates with the atmosphere. The second diameter portion 82 is provided between the first diameter portion 81 and the pressure chamber C. The ceiling surface of the pressure chamber C is configured with the vibrator 42. A piezoelectric element 44 is provided on the upper side of the pressure chamber C holding the vibrator 42. In the present specification, the piezoelectric element 44 may be referred to as a "pressure generating unit". The piezoelectric element 44 deforms in a vertical direction in FIG. 5 in accordance with an applied voltage. As the piezoelectric element 44 deforms, the vibrator 42 bends in the vertical direction in FIG. 5. The volume of the pressure chamber C is expanded by the bending of the vibrator 42 in the upward direction.

On the other hand, the volume of the pressure chamber C is reduced by the bending the vibrator 42 in the downward direction.

It should be noted that the piezoelectric element 44 can be driven at a relatively high frequency on the order of kilohertz (kHz).

Figure 6:
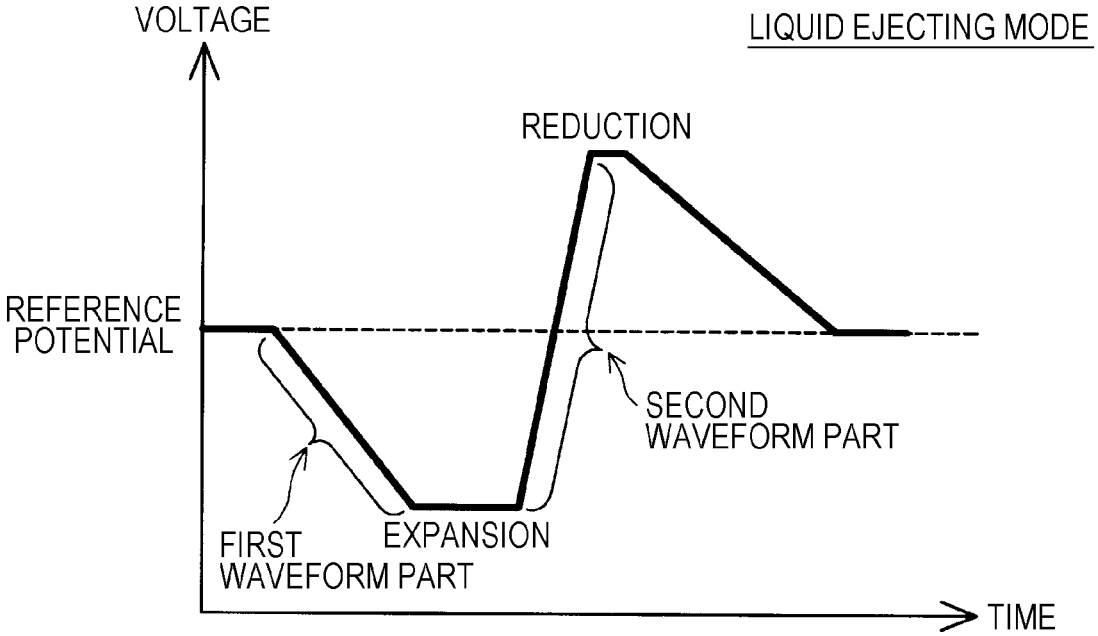
FIG. 6 is an explanatory graph showing an example of a waveform of a drive voltage in a liquid ejecting mode.
Figure 7:
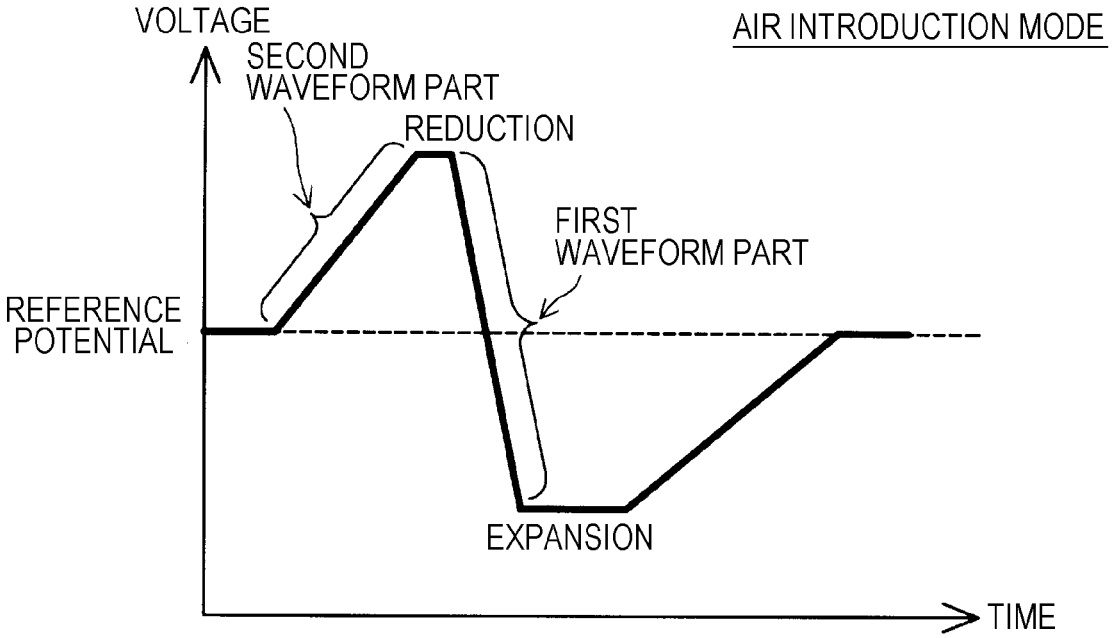
FIG. 7 is an explanatory graph showing an example of a waveform of a drive voltage in an air introduction mode.

FIG. 6 shows an example of a waveform of a drive voltage supplied to the piezoelectric element 44 in the liquid ejecting mode. FIG. 7 shows an example of a waveform of a drive voltage supplied to the piezoelectric element 44 in the air introduction mode. The horizontal axes in FIGS. 6 and 7 represent time in one ejecting cycle. The vertical axis represents the voltage applied to the piezoelectric element 44. The control unit 20 drives the piezoelectric element 44 by using drive waveforms including a first waveform part for expanding the volume of the pressure chamber C and a second waveform part for reducing the volume of the pressure chamber C. In the present embodiment, the control unit 20 is stored with a drive waveform of "liquid ejecting mode" for ejecting the ink from the nozzle N and a drive waveform of "air introduction mode" for introducing air into the pressure chamber C from the nozzle N during a period in which the ink is not ejected from the nozzle N. The drive waveform of the liquid ejecting mode is also referred to as a first drive waveform. The drive waveform of the air introduction mode is also referred to as a second drive waveform. The control unit 20 may have a drive waveform of a "micro vibration mode" that vibrates the meniscus of the ink in the nozzle N without ejecting the ink from the nozzle N. The control unit 20 selects one drive waveform from a plurality of drive waveforms according to an application and supplies the drive waveform to the piezoelectric element 44.

Referring to FIG. 6, in the liquid ejecting mode, the control unit 20 firstly expands the volume of the pressure chamber C by supplying the first waveform part to the piezoelectric element 44, and then reduces the volume of the pressure chamber C by supplying the second waveform part having a larger magnitude (absolute value) of the slope than the slope of the first waveform part to the piezoelectric element 44. Thereafter, the control unit 20 returns the voltage applied to the piezoelectric element 44 to a reference potential. As the volume of the pressure chamber C is reduced, the ink in the pressure chamber C is pressurized, and when the meniscus pressure resistance of the ink in the nozzle N is exceeded, the ink is ejected from the nozzle N. The meniscus pressure resistance refers to the maximum pressure under which the meniscus of the ink is not destroyed (that is, the meniscus can withstand).

Referring to FIG. 7, in the air introduction mode, the control unit 20 firstly reduces the volume of the pressure chamber C by supplying the second waveform part to the piezoelectric element 44, and then expands the volume of the pressure chamber C by supplying the first waveform part having a larger magnitude (absolute value) of the slope than the slope of the second waveform part to the piezoelectric element 44. Thereafter, the control unit 20 returns the voltage applied to the piezoelectric element 44 to a reference potential. The magnitude (absolute value) of the slope of the first waveform part in the air introduction mode is larger than the magnitude (absolute value) of the slope of the first waveform part in the liquid ejecting mode. Further, the magnitude (absolute value) of the slope of the second waveform part in the air introduction mode is smaller than the magnitude (absolute value) of the slope of the second waveform part in the liquid ejecting mode. Further, in the present embodiment, the control unit 20 drives the piezoelectric element 44 so that the volume of the air introduced from the nozzle N is equal to or larger than the volume of the first diameter portion 81. In the present embodiment, since the control unit 20 supplies the first waveform part after supplying the second waveform part to the piezoelectric element 44, it is possible to secure a large stroke amount of the piezoelectric element 44.

Figure 8:
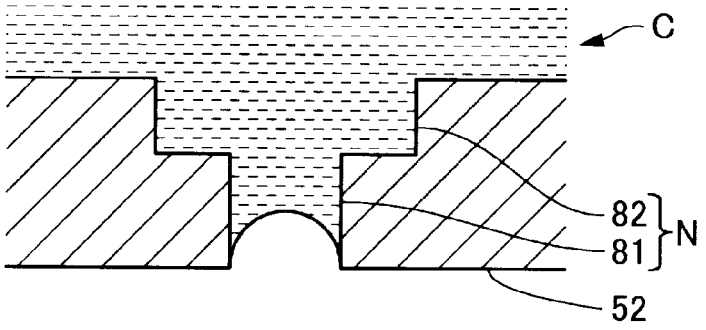
FIG. 8 is a first explanatory view showing a behavior of a liquid meniscus in an air introduction mode.
Figure 9:
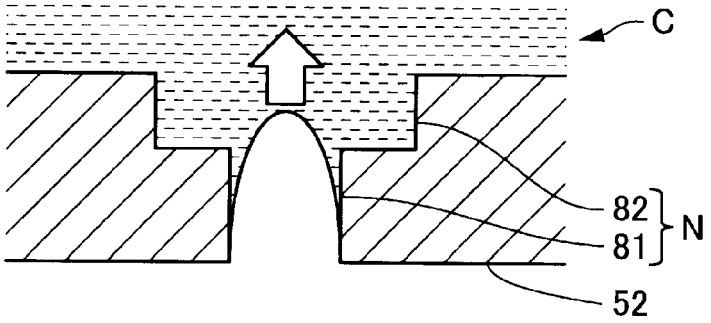
FIG. 9 is a second explanatory view showing the behavior of the liquid meniscus in the air introduction mode.
Figure 10:
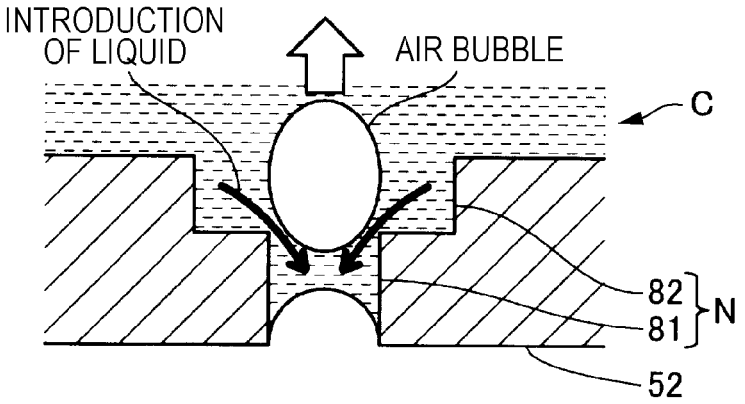
FIG. 10 is a third explanatory view showing the behavior of the liquid meniscus in the air introduction mode.

FIGS. 8 to 10 are explanatory views showing the behavior of the meniscus of the ink in the nozzle N when introducing the air from the nozzle N into the pressure chamber C. In an initial state, the meniscus of the ink is formed in the nozzle N as a liquid surface is recessed (see FIG. 8). Next, as the drive waveform shown in FIG. 7 is supplied to the piezoelectric element 44 and the volume of the pressure chamber C is expanded, the ink in the pressure chamber C is decompressed. Therefore, the depression of the liquid surface in the nozzle N increases toward the inside of the pressure chamber C (see FIG. 9). Further, as the ink pressure decreases, the meniscus of the ink in the nozzle N is destroyed, and an air bubble (air) is introduced into the pressure chamber C from the nozzle N. The introduced air bubble moves upward in the pressure chamber C by buoyancy. As the bubble moves, the ink near the nozzle N is stirred (see FIG. 10). Thereafter, the bubble introduced from the nozzle N is discharged to the second individual flow path 72 by the flow of the ink from the inside of the first individual flow path 61 to the inside of the second individual flow path 72.

Figure 11:
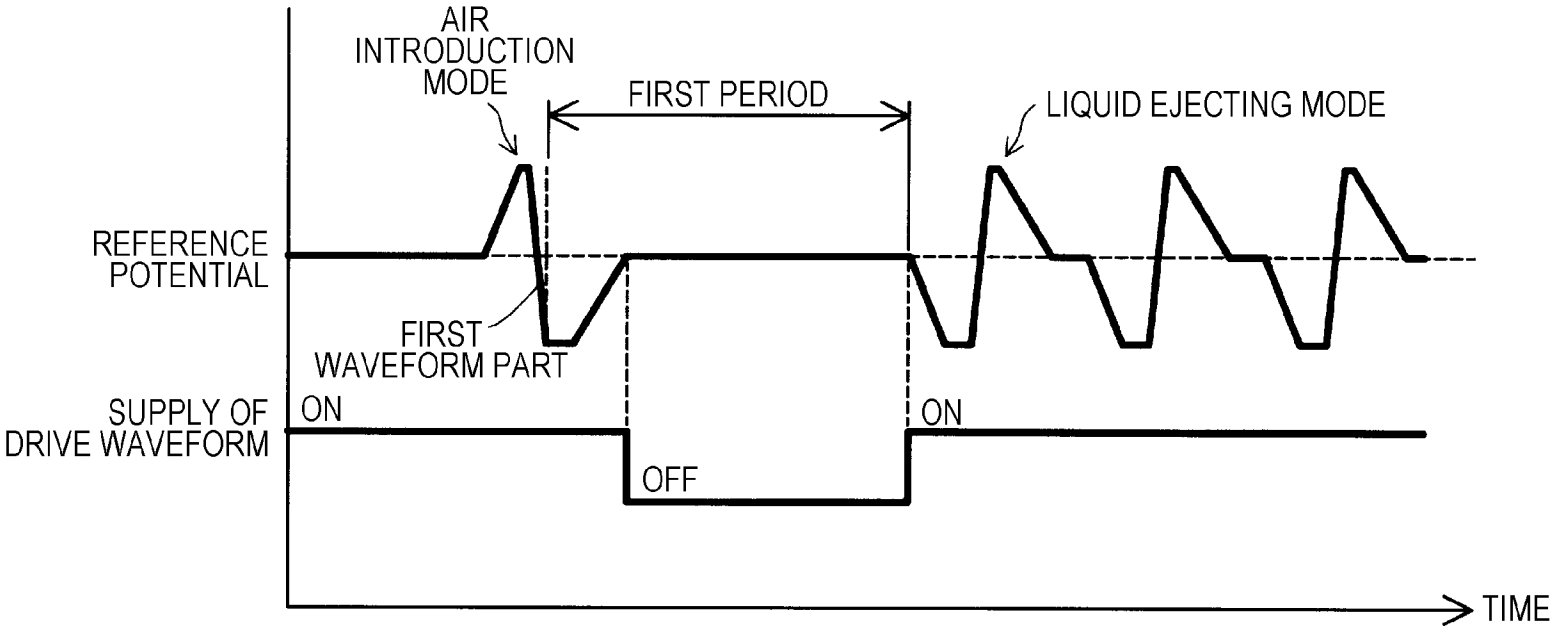
FIG. 11 is a first example of a timing chart showing a waveform of a drive voltage.

FIG. 11 is a first example of a timing chart showing both of a drive waveform in the liquid ejecting mode and a drive waveform in the air introduction mode. An example of the drive waveform supplied to the piezoelectric element 44 during printing is shown on the upper side of FIG. 11. ON/OFF of the supply of the drive waveform is shown on the lower side of FIG. 11. In the present embodiment, after introducing the air from the nozzle N into the pressure chamber C, the control unit 20 does not perform ejection of the ink from the nozzle N in a predetermined first period. That is, after supplying the first waveform part to the piezoelectric element 44 in the air introduction mode, the control unit 20 does not perform the liquid ejecting mode in the predetermined first period. In the present embodiment, after the control unit 20 supplies the first waveform part to the piezoelectric element 44, a period in which the bubble introduced from the nozzle N is transferred from the pressure chamber C to the second individual flow path 72 and discharged at the second common flow path 65 is taken as the first period. After the control unit 20 supplies the first waveform part to the piezoelectric element 44, the period in which the bubble introduced from the nozzle N is transferred from the pressure chamber C and discharged at the second common flow path 65 can be determined by a flow velocity of the ink and a distance La from the nozzle N to an entrance to the second common flow path 65 (see FIG. 5). After the control unit 20 supplies the first waveform part to the piezoelectric element 44, the period in which the bubble introduced from the nozzle N is transferred from the pressure chamber C and discharged at the second common flow path 65 may be determined by a test which is performed in advance.

In the present embodiment, after supplying the drive waveform in the air introduction mode, the control unit 20 cuts off a circuit that supplies the drive waveform from the control unit 20 to the piezoelectric element 44 in a predetermined period so as to obtain the first period. Note that the control unit 20 may obtain the first period by providing a period, in which the ink is not ejected from the nozzle N, in the drive waveform in the air introduction mode. The control unit 20 may obtain the first period by correcting the dot data of a print pixel after a halftone process is performed. It is preferable that the control unit 20 predict a period, in which the first period can be obtained and the ejection of the ink from the nozzle N is not disturbed, by the dot data or the like and perform the air introduction mode during the period in which the ejection of the ink from the nozzle N is not disturbed. However, if such period cannot be obtained, the control unit 20 may cancel the ejection of the ink from the nozzle N after the air introduction mode in order to obtain the first period. In this case, a pixel to be formed by the ejection of the ink from the nozzle N may be supplemented by the ejection of the ink from another nozzle.

Figure 12:
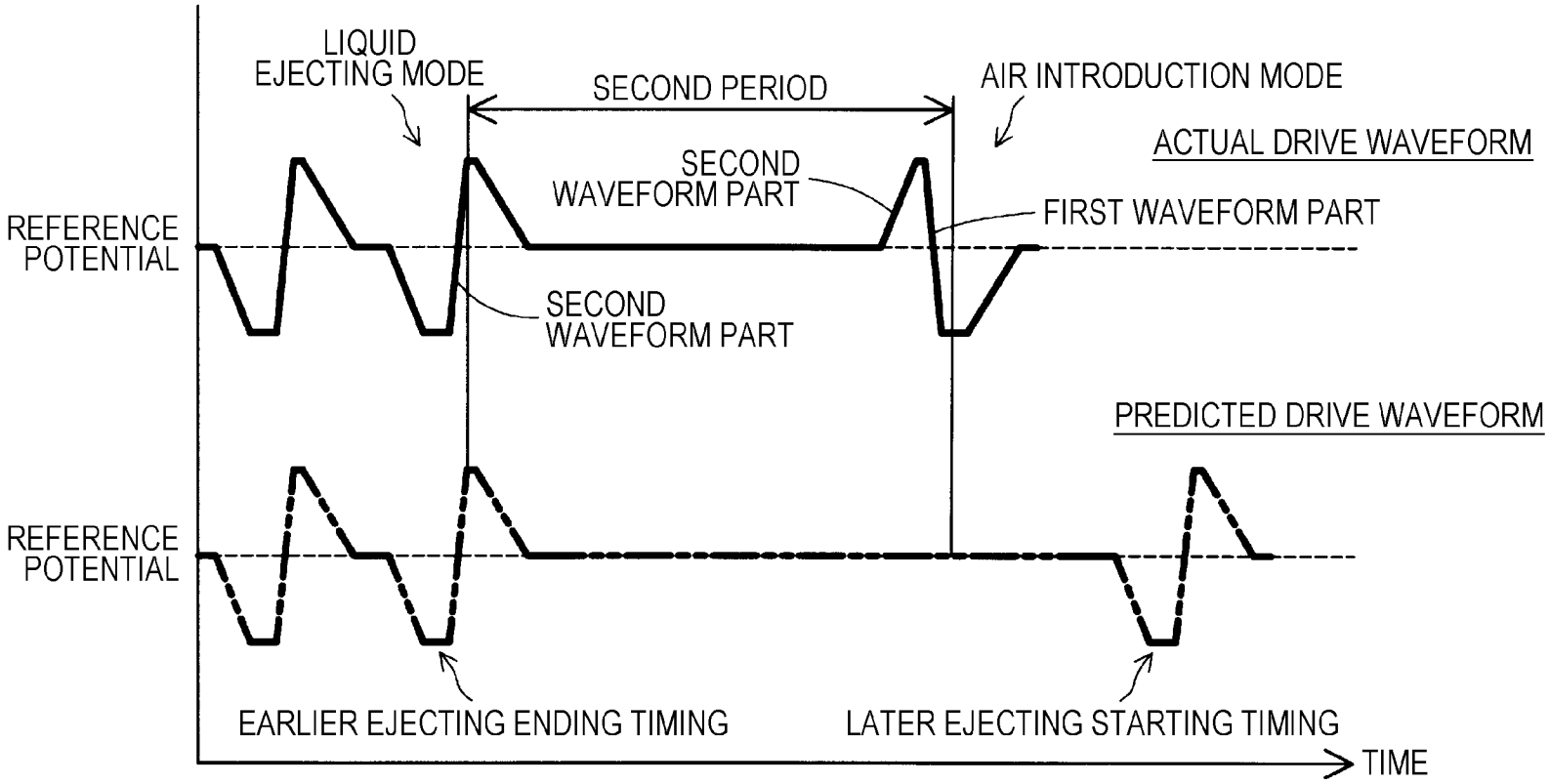
FIG. 12 is a second example of a timing chart showing a waveform of a drive voltage.

FIG. 12 is a second example of a timing chart showing both of a drive waveform in the liquid ejecting mode and a drive waveform in the air introduction mode. On the upper side of FIG. 12, an example of a drive waveform actually supplied to the piezoelectric element 44 is shown. On the lower side of FIG. 12, an example of a predicted drive waveform supplied to the piezoelectric element 44 is shown. In the present embodiment, the control unit 20 introduces the air into the pressure chamber C via the nozzle N when the ink is not ejected from the nozzle N during a predetermined second period. In the present embodiment, a period until the ink in the vicinity of the nozzle N is thickened to reach a predetermined viscosity causing an ejection failure is set as the second period. The period until the ink in the vicinity of the nozzle N is thickened to reach the predetermined viscosity can be obtained by a test which is performed in advance.

In the present embodiment, firstly, the control unit 20 predicts a drive waveform to be supplied to the piezoelectric element 44 by the dot data or the like, and acquires a timing for starting the supply of the second waveform part to the piezoelectric element 44 (later ejecting starting timing) in the later liquid ejecting mode, from a timing for ending the supply of the second waveform part to the piezoelectric element 44 (earlier ejecting ending timing) in the earlier liquid ejecting mode, in each of the adjacent drive waveforms of the liquid ejecting mode. Next, the control unit 20 compares the acquired period, from the earlier ejecting ending timing to the later ejecting starting timing, with the second period. When it is determined that the period from the earlier ejecting ending timing to the later ejecting starting timing is equal to or longer than the second period, the control unit 20 inserts a drive waveform of the air introduction mode at a timing earlier than the elapse of the second period from the earlier ejecting ending timing so that the supply of the first waveform part in the air introduction mode is started in the earlier timing. In addition, the control unit 20 further acquires a timing for starting the supply of the second waveform part to the piezoelectric element 44 in the liquid ejecting mode scheduled to be performed next from the timing at which the supply of the inserted first waveform part ends in the air introduction mode, and may determine again whether or not to insert the drive waveform in the air introduction mode.

According to the liquid ejecting apparatus 100 of the present embodiment described above, the piezoelectric element 44 is driven to change the pressure of the ink in the pressure chamber C and introduce the air into the pressure chamber C via the nozzle N. Accordingly, it is possible to stir the ink in the vicinity of the nozzle N and to suppress the increase in viscosity of the ink in the vicinity of the nozzle N. Therefore, it is possible to complete an operation for suppressing the increase in viscosity of the ink in the vicinity of the nozzle N in a short time.

In addition, in the present embodiment, the control unit 20 drives the piezoelectric elements 44 provided in the respective pressure chambers C to introduce air into the pressure chamber C from the nozzle N. For this reason, it is possible to introduce the air for each nozzle N. In addition, since the air is introduced from the nozzle N using the piezoelectric element 44 having excellent responsiveness, the air can be introduced from the nozzle N into the pressure chamber C at high speed.

Further, in the present embodiment, the magnitude of the slope of the first waveform part in the air introduction mode is larger than the magnitude of the slope of the first waveform part in the liquid ejecting mode. Therefore, the volume of the pressure chamber C is expanded more rapidly compare to the liquid ejecting mode, and a large pressure change can be generated in the ink in the pressure chamber C. Therefore, the air can be introduced into the pressure chamber C from the nozzle N.

Further, in the present embodiment, since the magnitude of the slope of the second waveform part in the air introduction mode is smaller than the magnitude of the slope of the second waveform part in the liquid ejecting mode, the volume of the pressure chamber C is more gradually reduced compared to the liquid ejecting mode so that a sudden pressure change in the ink in the pressure chamber C can be suppressed. Therefore, even after the air is introduced from the nozzle N and the meniscus of the ink in the nozzle N is in an unstable state, the leakage of the ink from the nozzle N can be suppressed. In this case, when the volume of the pressure chamber C is reduced, the meniscus of the ink in the nozzle N is not destroyed, and the ink in the pressure chamber C flows through the first individual flow path 61 and the second individual flow path 72 which have lower flow resistances than the inside of the nozzle N.

Further, in the present embodiment, the control unit 20 does not perform the ejection of the ink from the nozzle N during the first period which is from introducing the air from the nozzle N into the pressure chamber C to discharging the bubble introduced from the nozzle N from the pressure chamber C into the second individual flow path 72. Therefore, the pressure change generated in the pressure chamber C by driving the piezoelectric element 44 is absorbed by the air (air bubble) introduced from the nozzle N, and an occurrence of the ejection failure of the ink from the nozzle N can be suppressed.

Further, in the present embodiment, the control unit 20 drives the piezoelectric element 44 so that the volume of the air introduced from the nozzle N is equal to or larger than the volume of the first diameter portion 81 which is the minimum diameter portion of the nozzle N.

Therefore, an amount of the air equal to or larger than the volume of the first diameter portion 81 is introduced into the pressure chamber C, and the ink in the vicinity of the nozzle N can be reliably stirred.

In addition, in the present embodiment, the control unit 20 introduces the air into the pressure chamber C via the nozzle N in the case where the ink in the vicinity of the nozzle N is not ejected from the nozzle N for the second period or longer in which a viscosity of the ink is increased to reach a predetermined viscosity causing an ejection failure. Therefore, it is possible to introduce the air from the nozzle N at an appropriate timing.

B. Other Embodiments (B1) The liquid ejecting apparatus 100 of the first embodiment described above was described as a piezo type having a piezoelectric element 44 as a pressure generating unit, but may be a thermal type or a valve type.

Figure 13:
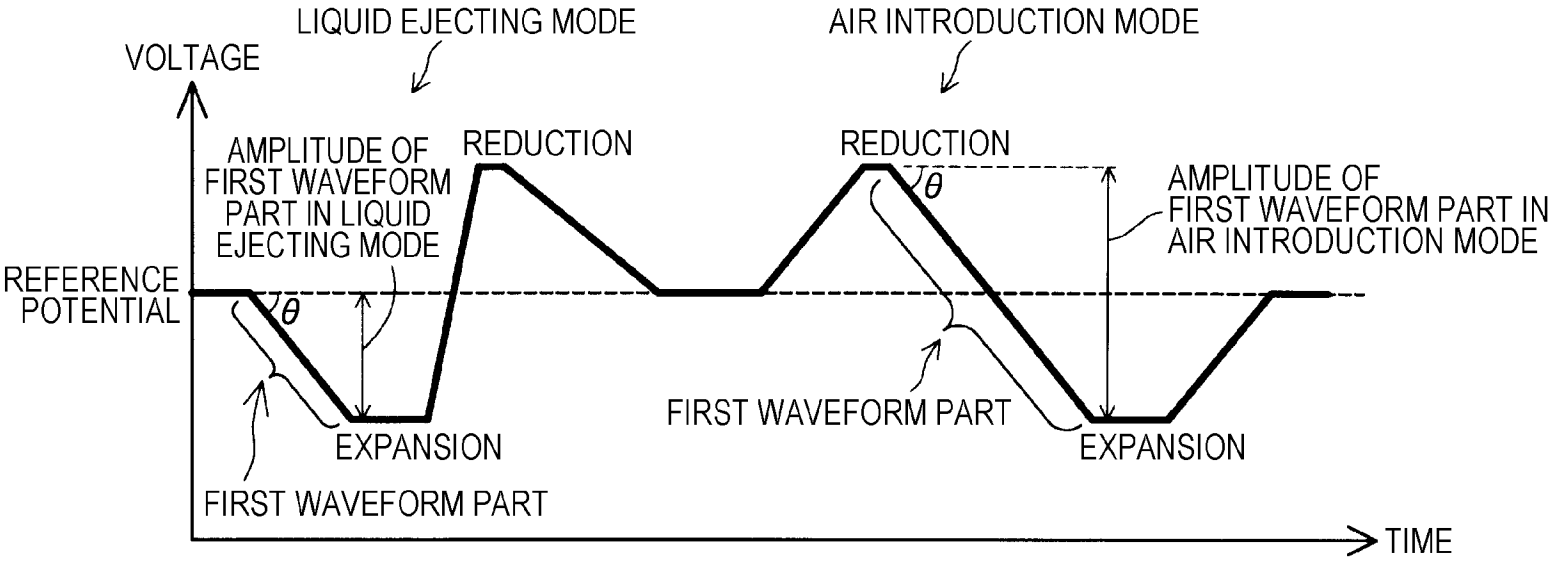
FIG. 13 is an explanatory diagram showing an example of a waveform of a drive voltage in another embodiment.

(B2) FIG. 13 shows an example of a waveform of a drive voltage supplied to the piezoelectric element 44 in the liquid ejecting mode and the air introduction mode according to the other embodiment. In the liquid ejecting apparatus 100 of the first embodiment described above, the magnitude of the slope of the first waveform part in the air introduction mode is larger than the magnitude of the slope of the first waveform part in the liquid ejecting mode. On the contrary, assuming that the magnitude of the slope of the first waveform part in the air introduction mode (θ shown in FIG. 13) is the same as the magnitude of the slope of the first waveform part in the liquid ejecting mode, the amplitude of the first waveform part in the air introduction mode may be made larger than the amplitude of the first waveform part in the liquid ejecting mode. The amplitude of the first waveform part means the potential difference between the maximum potential and the minimum potential in the first waveform part. In this case, when the air is introduced into the pressure chamber C, the volume of the pressure chamber C is greatly expanded compared with the case where the ink is ejected from the nozzle N, and a large pressure change in the ink in the pressure chamber C can be generated. Therefore, the air can be introduced into the pressure chamber C from the nozzle N, and the ink in the vicinity of the nozzle N can be stirred. The magnitude of the slope of the first waveform part in the air introduction mode may be set to be larger than the magnitude of the slope of the first waveform part in the liquid ejecting mode, and the amplitude of the first waveform part in the air introduction mode may be set to be larger than the amplitude of the first waveform part in the liquid ejecting mode. In this case, a larger amount of the air can be introduced into the pressure chamber C from the nozzle N, and the ink in the vicinity of the nozzle N can be stirred more. Similarly to the liquid ejecting mode, after supplying the first waveform part to the piezoelectric element 44 to expand the volume of the pressure chamber C, the second waveform part may be supplied to the piezoelectric element 44 to reduce the volume of the pressure chamber C. Thereafter, a drive voltage having a larger amplitude than an amplitude in the liquid ejecting mode may be supplied to the piezoelectric element 44 to expand the volume of the pressure chamber C.

(B3) In the liquid ejecting apparatus 100 of the first embodiment described above, the magnitude of the slope of the second waveform part in the air introduction mode is smaller than the magnitude of the slope of the second waveform part in the liquid ejecting mode. On the other hand, the magnitude of the slope of the second waveform part in the air introduction mode may be equal to the magnitude of the slope of the second waveform part in the liquid ejecting mode.

(B4) In the liquid ejecting apparatus 100 according to the first embodiment described above, the control unit 20 may control the circulation mechanism 75 to reverse the direction of the ink circulation. That is, the control unit 20 may switch the flow path through which the ink in the pressure chamber C is discharged in the first individual flow path 61 and the second individual flow path 72. When the flow path through which the ink in the pressure chamber C is discharged is switched in the first individual flow path 61 and the second individual flow path 72, the control unit 20 may change the first period. When the ink circulation direction is reversed, the length of the flow path until the air (air bubble) is discharged is changed from the distance La from the nozzle N to the second common flow path 65 shown in FIG. 5 to the distance Lb from the nozzle N shown in FIG. 5 to the first common flow path 60. Therefore, the first period after the change can be determined by the flow velocity of the ink and the distance Lb from the nozzle N to the entrance of the first common flow path 60 (see FIG. 5).

After the control unit 20 supplies the first waveform part to the piezoelectric element 44, the period in which the bubble introduced from the nozzle N is transferred from the pressure chamber C and discharged at the first common flow path 60 may be determined by a test which is performed in advance. In this case, even when the direction of the ink circulation is switched, it is possible to reliably ensure the time in which the air introduced from the nozzle N moves from the inside of the pressure chamber C and is discharged at the first common flow path 60. Further, the pressure change generated in the pressure chamber C by driving the piezoelectric element 44 is absorbed by the air (air bubble) introduced from the nozzle N, and an occurrence of the ejection failure of the ink from the nozzle N can be suppressed. In addition to the case where the direction of circulation is changed, the control unit 20 may change the first period when the flow rate of the ink is changed or the like. In addition, the liquid ejecting apparatus 100 may be provided with a temperature sensor so that the control unit 20 is configured to be able to acquire an outside air temperature at an installation location of the liquid ejecting apparatus 100, and may change the first period according to the change in the acquired outside air temperature.

(B5) In the liquid ejecting apparatus 100 according to the first embodiment described above, the control unit 20 supplies the drive waveform of the air introduction mode for one cycle to the piezoelectric element 44. Accordingly, the control unit 20 drives the piezoelectric element 44 so that the volume of the air introduced from the nozzle N is equal to or larger than the volume of the first diameter portion 81 which is the minimum diameter portion of the nozzle N. On the other hand, the control unit 20 may drive the piezoelectric element 44 such that the drive waveforms in the air introduction mode are continuously supplied to the piezoelectric element 44 over a plurality of cycles so that the total amount of the air introduced from the nozzle N is equal to or larger than the volume of the first diameter portion 81. Even in this case, the ink in the vicinity of the nozzle N can be stirred.

It is more preferable that the amount of the air introduced from the nozzle N be equal to or larger than the total volume of the volume of the first diameter portion 81 and the volume of the second diameter portion 82. In this case, the ink in the vicinity of the nozzle N can be more reliably stirred. If the volume of the air introduced from the nozzle N is large, the ink in the vicinity of the nozzle is sufficiently stirred when the air is introduced from the nozzle N even if the air (air bubble) does not move due to buoyancy.

(B6) In the liquid ejecting apparatus 100 according to the first embodiment described above, the period until the ink in the vicinity of the nozzle N is thickened to reach a predetermined viscosity causing the ejection failure is set as the second period, and the control unit 20 introduces the air into the pressure chamber C via the nozzle N when the ink is not ejected from the nozzle N during the predetermined second period. On the other hand, the control unit 20 may constantly introduce the air into the pressure chamber C via the nozzle N during the period in which the ejection of the ink from the nozzle N is not disturbed.

(B7) In the liquid ejecting apparatus 100 according to the first embodiment described above, the plurality of drive waveforms relating to the liquid ejecting mode and the air introduction mode are stored in the control unit 20, and the control unit 20 selects one drive waveform among the plurality of drive waveforms according to an application and supplies the drive waveform to the piezoelectric element 44. On the other hand, the control unit 20 stores one drive waveform in which a drive waveform in the liquid ejecting mode and a drive waveform in the air introduction mode are connected, and the control unit 20 may be controlled by switching so that a desired mode part which is included in one drive waveform is supplied to the piezoelectric element 44.

(B8) In the liquid ejecting apparatus 100 according to the first embodiment described above, the control unit 20 performs the air introduction mode while the carriage 25 moves during printing. On the other hand, the air introduction mode may be performed at the timing when the moving direction of the carriage 25 switches (at carriage turn).

(B9) In the liquid ejecting apparatus 100 according to each of the embodiments described above, a flow path of the ink that communicates the pressure chamber C with the first common flow path 60 may be provided separately from the first individual flow path 61. In addition, a flow path of the ink that communicates the pressure chamber C with the second common flow path 65 may be provided separately from the second individual flow path 72.

(B10) In the liquid ejecting apparatus 100 according to each of the embodiments described above, the control unit 20 may introduce the air into the pressure chamber C via the nozzle N by the head cap 400 provided on the opposite side of the pressure chamber C with the nozzle N interposed therebetween. In this case, the control unit 20 moves the head cap 400, covers the liquid ejecting head 26 with the head cap 400, and drives the head cap 400 to pressurize the air in the head cap 400. Therefore, in the present specification, the head cap 400 may be referred to as "pressure generating unit". When the air in the head cap 400 is pressurized, the air is pumped into the pressure chamber C via the nozzle N. That is, the pressure of the ink in the pressure chamber C is pressurized via the nozzle N. The control unit 20 may seal the first individual flow path 61 communicating with the pressure chamber C and the second individual flow path 72 with a valve, a shutter, or the like, make the air in the head cap 400 have a negative pressure, and thereafter, remove the head cap 400 from the liquid ejecting head 26. In this case, by making the air in the head cap 400 have a negative pressure, the inside of the nozzle N becomes a negative pressure. Thereafter, if the head cap 400 is removed, the air flows into the nozzle N due to the pressure difference between the inside and the outside of the nozzle N. In this case, the air can be introduced into the pressure chamber C via the nozzle N by generating a pressure change in the ink in the pressure chamber C from the outside of the pressure chamber C via the nozzle N, and thereby it is possible to stir the ink in the vicinity of the nozzle N and suppress the increase in viscosity of the ink in the vicinity of the nozzle N.

C. Other Embodiments

The present disclosure is not limited to the embodiments described above, and can be realized in various forms without departing from the gist thereof. For example, the present disclosure can be realized by the following forms. Technical features in the above embodiments corresponding to the technical features in each of the embodiments described below may be replaced or combined as appropriate in order to solve part or all of the problems of the present disclosure or to achieve part of all of the effects of the present disclosure. Also, unless the technical features are described as essential in this specification, it can be deleted as appropriate.

(1) According to an embodiment of the present disclosure, a liquid ejecting apparatus is provided. The liquid ejecting apparatus includes a nozzle for ejecting liquid, a pressure chamber communicating with the nozzle, a first individual flow path communicating with the pressure chamber, a second individual flow path communicating with the pressure chamber, a pressure generating unit changing a pressure of the liquid in the pressure chamber, and a control unit for driving the pressure generating unit. The liquid is supplied into the pressure chamber through one of the first individual flow path and the second individual flow path, and at least a part of the liquid supplied into the pressure chamber is discharged through the other. The control unit introduces air into the pressure chamber through the nozzle by driving the pressure generating unit during a period in which the liquid is not ejected from the nozzle.

According to the liquid ejecting apparatus of the embodiment, the pressure of the liquid in the pressure chamber is changed and the air is introduced into the pressure chamber via the nozzle by driving the pressure generating unit. Accordingly, it is possible to stir the liquid in the vicinity of the nozzle and to suppress an increase in viscosity of the liquid in the vicinity of the nozzle. Therefore, it is possible to perform the operation for suppressing the increase in viscosity of the liquid in the vicinity of the nozzle in a short time.

(2) In the liquid ejecting apparatus of the embodiment described above, the pressure generating unit is provided in the pressure chamber, and the control unit may depressurize the liquid in the pressure chamber by driving the pressure generating unit and introduce the air into the pressure chamber via the nozzle.

According to the liquid ejecting apparatus of the embodiment, the air can be introduced into the pressure chamber via the nozzle by driving the pressure generating unit to decompress the inside of the pressure chamber.

(3) In the liquid ejecting apparatus of the embodiment described above, the control unit drives the pressure generating unit using a first drive waveform, for ejecting liquid from the nozzle, including a first waveform part for expanding a volume of the pressure chamber and a second waveform part for reducing the volume of the pressure chamber, and a second drive waveform, for introducing the air into the pressure chamber via the nozzle, including a first waveform part for expanding the volume of the pressure chamber and a second waveform part for reducing the volume of the pressure chamber. A magnitude of a slope of the first waveform part in the second drive waveform may be larger than a magnitude of a slope of the first waveform part in the first drive waveform.

According to the liquid ejecting apparatus of the embodiment, when the air is introduced into the pressure chamber, the volume of the pressure chamber is rapidly expanded compared with the case where the liquid is ejected from the nozzle, and a large pressure change in the liquid in the pressure chamber can be generated. Therefore, the air can be introduced into the pressure chamber from the nozzle.

(4) In the liquid ejecting apparatus of the embodiment described above, a magnitude of a slope of the second waveform part in the second drive waveform may be smaller than a magnitude of a slope of the second waveform part in the first drive waveform.

According to the liquid ejecting apparatus of the embodiment, when the air is introduced into the pressure chamber, the volume of the pressure chamber is gradually reduced compared with the case where the liquid is ejected from the nozzle, and a rapid pressure change in the liquid in the pressure chamber can be suppressed. Therefore, leakage of the liquid from the nozzle can be suppressed.

(5) In the liquid ejecting apparatus of the embodiment described above, the control unit drives the pressure generating unit using a first drive waveform, for ejecting liquid from the nozzle, including a first waveform part for expanding a volume of the pressure chamber and a second waveform part for reducing the volume of the pressure chamber, and a second drive waveform, for introducing the air into the pressure chamber via the nozzle, including a first waveform part for expanding the volume of the pressure chamber and a second waveform part for reducing the volume of the pressure chamber. A magnitude of an amplitude of the first waveform part in the second drive waveform may be larger than a magnitude of an amplitude of the first waveform part in the first drive waveform.

According to the liquid ejecting apparatus of the embodiment, when the air is introduced into the pressure chamber, the volume of the pressure chamber is greatly expanded compared with the case where the liquid is ejected from the nozzle, and a large pressure change in the liquid in the pressure chamber can be generated. Therefore, the air can be introduced into the pressure chamber from the nozzle.

(6) In the liquid ejecting apparatus of the embodiment described above, the pressure generating unit is provided on an opposite side of the pressure chamber across the nozzle, and the control unit may change the pressure of the liquid in the pressure chamber via the nozzle by driving the pressure generating unit and may introduce the air into the pressure chamber via the nozzle.

According to the liquid ejecting apparatus of the embodiment, it is possible to introduce the air into the pressure chamber via the nozzle by generating a pressure change in the liquid in the pressure chamber via the nozzle from the outside of the pressure chamber.

(7) In the liquid ejecting apparatus of the embodiment described above, the control unit may not perform ejection of the liquid from the nozzle during a predetermined first period after introducing the air into the pressure chamber from the nozzle.

According to the liquid ejecting apparatus of the embodiment, it is possible to ensure the time during which the air introduced from the nozzle is discharged from the pressure chamber. Therefore, it is possible to suppress the pressure change of the liquid in the pressure chamber from being absorbed by the air remaining in the pressure chamber and to suppress the occurrence of the ejection failure of the liquid from the nozzle.

(8) In the liquid ejecting apparatus of the embodiment described above, the control unit may change the first period when the flow path through which the liquid in the pressure chamber is discharged is switched in the first individual flow path and the second individual flow path.

According to the liquid ejecting apparatus of the embodiment, it is possible to more reliably ensure the time until the air introduced from the nozzle is discharged from the pressure chamber.

(9) In the liquid ejecting apparatus of the embodiment described above, the control unit may drive the pressure generating unit so that a volume of the air introduced from the nozzle is equal to or larger than a volume of the nozzle.

According to the liquid ejecting apparatus of the embodiment, the liquid in the vicinity of the nozzle can be reliably stirred.

(10) In the liquid ejecting apparatus of the embodiment described above, the nozzle may have a first diameter portion and a second diameter portion having an inner diameter larger than the inner diameter of the first diameter portion, and the control unit may drive the pressure generating unit so that a volume of the air introduced from the nozzle is equal to or larger than a volume of the first diameter portion.

According to the liquid ejecting apparatus of the embodiment, the liquid in the vicinity of the nozzle can be reliably stirred.

(11) In the liquid ejecting apparatus of the embodiment described above, the control unit may introduce the air into the pressure chamber via the nozzle when the liquid from the nozzle is not ejected during a predetermined second period.

According to the liquid ejecting apparatus of the embodiment, it is possible to introduce the air from the nozzle at an appropriate timing.

(12) According to the second embodiment of the present disclosure, a liquid ejecting apparatus is provided. The liquid ejecting apparatus includes a nozzle for ejecting liquid, a pressure chamber communicating with the nozzle, a first individual flow path communicating with the pressure chamber, a second individual flow path communicating with the pressure chamber, a pressure generating unit changing a pressure of the liquid in the pressure chamber and provided in the pressure chamber, and a control unit for driving the pressure generating unit using a drive waveform including a first waveform part for expanding a volume of the pressure chamber and a second waveform part for reducing the volume of the pressure chamber. The control unit drives the pressure generating unit using the first waveform part, during a period in which the liquid is not ejected from the nozzle, of which a magnitude of a slope is larger than a magnitude of a slope of the first waveform part for ejecting the liquid from the nozzle.

According to the liquid ejecting apparatus of the embodiment, the pressure of the liquid in the pressure chamber is changed by driving the pressure generating unit. Accordingly, it is possible to introduce the air into the pressure chamber via the nozzle, stir the liquid in the vicinity of the nozzle and suppress the increase in viscosity of the liquid in the vicinity of the nozzle. Therefore, it is possible to perform the operation for suppressing the increase in viscosity of the liquid in the vicinity of the nozzle in a short time.

The present disclosure can be realized in various forms other than the liquid ejecting apparatus. For example, it can be realized in the form of a liquid ejecting method, and a liquid ejecting head, a computer program for realizing the control method thereof, a non-transitory recording medium in which the computer program is recorded, and the like.

The present application is based on, and claims priority from JP Application Serial Numbers 2018-054068, filed Mar., 22, 2018, and 2018-196578, filed Oct. 18, 2018, the disclosure of which are hereby incorporated by reference herein in its entirety.

What is claimed is:

1. A liquid ejecting apparatus comprising:

a nozzle for ejecting liquid;

a pressure chamber communicating with the nozzle;

a first individual flow path communicating with the pressure chamber;

a second individual flow path communicating with the pressure chamber;

a pressure generating unit changing a pressure of the liquid in the pressure chamber; and a control unit for driving the pressure generating unit, wherein the liquid is supplied into the pressure chamber through one of the first individual flow path and the second individual flow path, and at least a part of the liquid supplied into the pressure chamber is discharged via the other, and the control unit introduces air into the pressure chamber via the nozzle by driving the pressure generating unit, during a period in which the liquid is not ejected from the nozzle.

2. The liquid ejecting apparatus according to claim 1, wherein the pressure generating unit is provided in the pressure chamber, and the control unit depressurizes the liquid in the pressure chamber by driving the pressure generating unit and introduces the air into the pressure chamber via the nozzle.

3. The liquid ejecting apparatus according to claim 2, wherein the control unit drives the pressure generating unit using a first drive waveform, for ejecting the liquid from the nozzle, including a first waveform part for expanding a volume of the pressure chamber and a second waveform part for reducing the volume of the pressure chamber, and a second drive waveform, for introducing the air into the pressure chamber via the nozzle, including a first waveform part for expanding the volume of the pressure chamber and a second waveform part for reducing the volume of the pressure chamber, and a magnitude of a slope of the first waveform part in the second drive waveform is larger than a magnitude of a slope of the first waveform part in the first drive waveform.

4. The liquid ejecting apparatus according to claim 3, wherein a magnitude of a slope of the second waveform part in the second drive waveform is smaller than a magnitude of a slope of the second waveform part in the first drive waveform.

5. The liquid ejecting apparatus according to claim 2, wherein the control unit drives the pressure generating unit using a first drive waveform, for ejecting the liquid from the nozzle, including a first waveform part for expanding a volume of the pressure chamber and a second waveform part for reducing the volume of the pressure chamber, and a second drive waveform, for introducing the air into the pressure chamber via the nozzle, including a first waveform part for expanding the volume of the pressure chamber and a second waveform part for reducing the volume of the pressure chamber, and a magnitude of an amplitude of the first waveform part in the second drive waveform is larger than a magnitude of an amplitude of the first waveform part in the first drive waveform.

6. The liquid ejecting apparatus according to claim 1, wherein the pressure generating unit is provided on an opposite side of the pressure chamber across the nozzle, and the control unit changes the pressure of the liquid in the pressure chamber via the nozzle by driving the pressure generating unit and introduces the air into the pressure chamber via the nozzle.

7. The liquid ejecting apparatus according to claim 1, wherein the control unit does not perform ejection of the liquid from the nozzle during a predetermined first period after introducing the air into the pressure chamber from the nozzle.

8. The liquid ejecting apparatus according to claim 7, wherein the control unit changes the first period when a flow path through which the liquid in the pressure chamber is discharged is switched in the first individual flow path and the second individual flow path.

9. The liquid ejecting apparatus according to claim 1, wherein the control unit drives the pressure generating unit so that a volume of the air introduced from the nozzle is equal to or larger than a volume of the nozzle.

10. The liquid ejecting apparatus according to claim 1, wherein the nozzle has a first diameter portion and a second diameter portion having an inner diameter larger than an inner diameter of the first diameter portion, and the control unit drives the pressure generating unit so that a volume of the air introduced from the nozzle is equal to or larger than a volume of the first diameter portion.

11. The liquid ejecting apparatus according to claim 1, wherein the control unit introduces the air into the pressure chamber via the nozzle when the liquid from the nozzle is not ejected during a predetermined second period.

12. The liquid ejecting apparatus according to claim 1, the control unit is configured to introduce air into the pressure chamber via the nozzle during circulating the liquid through the pressure chamber from one of the first individual flow path and the second individual flow path, into the other.

13. A liquid ejecting apparatus comprising:

a nozzle for ejecting liquid;

a pressure chamber communicating with the nozzle;

a first individual flow path communicating with the pressure chamber;

a second individual flow path communicating with the pressure chamber;

a pressure generating unit provided in the pressure chamber and changing a pressure of the liquid in the pressure chamber; and a control unit for driving the pressure generating unit using a drive waveform including a first waveform part for expanding a volume of the pressure chamber and a second waveform part for reducing the volume of the pressure chamber, wherein the control unit drives the pressure generating unit using the first waveform part, during a period in which the liquid is not ejected from the nozzle, of which a magnitude of a slope is larger than a magnitude of a slope of the first waveform part for ejecting the liquid from the nozzle.

14. The liquid ejecting apparatus according to claim 13, the control unit is configured to introduce air into the pressure chamber via the nozzle during circulating the liquid through the pressure chamber from one of the first individual flow path and the second individual flow path, into the other.

15. A method performed in a liquid ejecting apparatus including a nozzle for ejecting liquid, a pressure chamber communicating with the nozzle, a first individual flow path communicating with the pressure chamber, and a second individual flow path communicating with the pressure chamber, the method comprising:

supplying the liquid into the pressure chamber via one of the first individual flow path and the second individual flow path and discharging at least a part of the liquid supplied into the pressure chamber via the other; and introducing air into the pressure chamber via the nozzle by changing a pressure of the liquid in the pressure chamber during a period in which the liquid is not ejected from the nozzle.

16. The method according to claim 15, wherein the introducing air into the pressure chamber via the nozzle accompanies circulating the liquid through the pressure chamber from one of the first individual flow path and the second individual flow path, into the other.

* * * * *